United States Patent [19]

McGillick

[11] 3,978,655

[45] Sept. 7, 1976

[54] TIME CLOCK

[75] Inventor: Raymond McGillick, Kinnelon, N.J.

[73] Assignee: Lawrence Peska Associates, Inc., New York, N.Y. ; a part interest

[22] Filed: Aug. 4, 1975

[21] Appl. No.: 601,804

[52] U.S. Cl. ..... 58/126 R; 58/127 R

[51] Int. Cl.[2] ..... G04B 19/00

[58] Field of Search ..... 58/126 R, 126 A, 126 D, 58/125 R, 125 B, 59, 128, 127 R

[56] References Cited

UNITED STATES PATENTS

| | | | |
|---|---|---|---|
| 797,219 | 8/1905 | Porter | 58/127 R |
| 864,467 | 8/1907 | Ingraham | 58/127 R |
| 2,305,283 | 12/1942 | Theilkas | 58/126 R |
| 2,380,171 | 7/1945 | Hammer | 58/126 R |
| 2,723,527 | 11/1955 | Smith | 58/126 A |
| 2,886,942 | 5/1959 | Stucky | 58/126 R |

*Primary Examiner*—Ulysses Weldon
*Attorney, Agent, or Firm*—Richard E. Nanfeldt

[57] ABSTRACT

A time clock having a revolving face dial includes a housing, a watch movement and a ternary of rotatable shafts cooperating with the watch movement, wherein second, minute and hour hands are affixed onto the free ends of the shafts. The second hand is integrally affixed onto the dial face thereby causing rotation of the dial face in union with the second hand through 360° every minute.

6 Claims, 2 Drawing Figures

TIME CLOCK

BACKGROUND OF THE INVENTION

A number of U.S. Pat. Nos. 3,785,530; 3,796,043; and 3,803,831 have employed variously designed time clocks, but none of these aforementioned time clocks provide a method for rotating the dial face in union with the second hand.

U.S. Pat. No. 2,785,530 employs two rotating disc of contrasting colors for indicating time. U.S. Pat. No. 3,796,043 employs two adjacent surfaces of contrasting shade to illustrate a pictorial passage of time. U.S. Pat. No. 3,803,831 employs two or more graduated discs in a co-centric relationship to one another thereby permitting an indication of time.

SUMMARY OF THE INVENTION

My present invention relates to a unique and novel time clock, wherein the dial face rotates in union with the second hand through 360° in a one minute interval.

An object of my present invention is to provide a novelty time clock, wherein the face dial rotates in union with the second hand through 360°'s every minute.

A further object of my present invention is to provide a means for integrally affixing the second hand to the face dial of the time clock.

It is still a further object of my present invention to provide a novelty time clock having a revolving face dial.

Briefly, my present invention comprises a housing, a watch movement and a ternary of rotatable shafts cooperating with the watch movement, wherein second, minute and hour hands are affixed onto the free ends of the shaft. The second hand is integrally affixed onto the dial face thereby causing rotation of the dial face in union with the second hand through 360° every minute.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERReD EMBODIMENT

Figure 1:
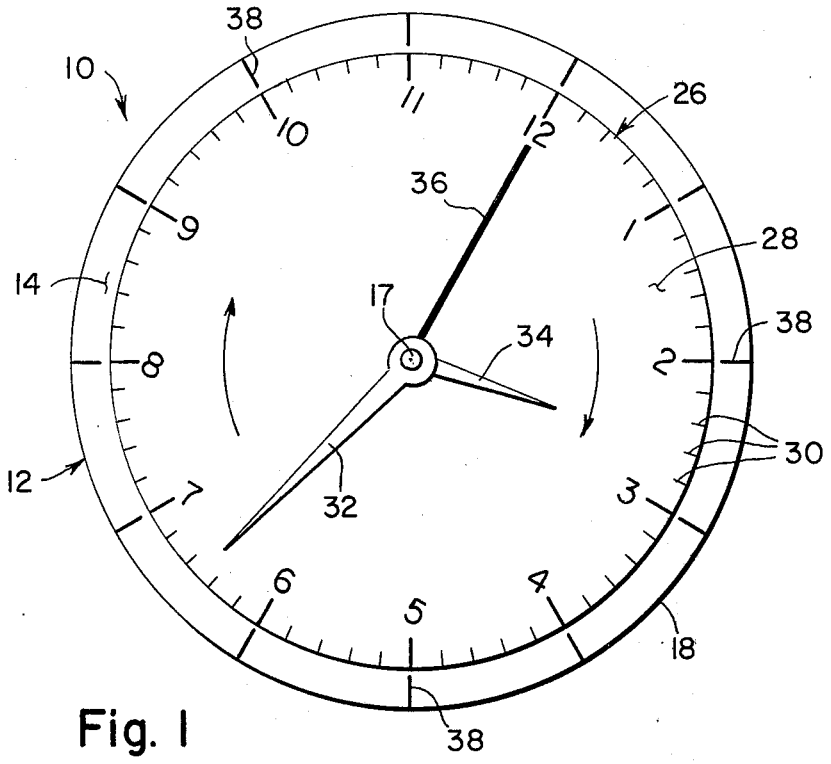
FIG. 1 illustrates a front view of a time clock having a revolving face dial.
Figure 2:
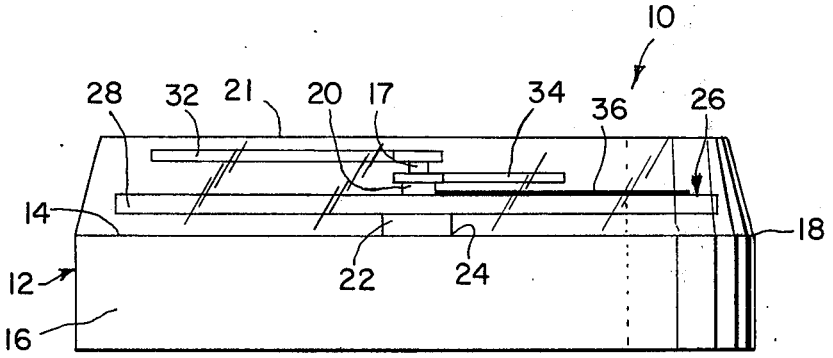
FIG. 2 illustrates an end elevational view of the time clock.

Turning now descriptively to the drawings, in which similar reference characters denote similar elements throughout the several views, FIGS. 1–2 show a revolving face dial time clock which comprises a housing having an open front wall and a chamber therein, wherein an annular flange member holds a transparent lens 21 in place over the open front wall. A conventionally styled clock mechanism (not shown) is contained within chamber wherein a ternary of shafts 17 communicate with the clock mechanism. The shafts 17 are arranged one within the other thereby permitting independent rotation of the shafts. The ternary of shafts 17 extend outwardly through a center aperture in the open front wall 14. The front face of the dial has printed sixty points thereon at an equidistantly spaced intervals radially there around with five minute designations labelled as shown from one to twelve. The points can be formed from a phosphorescent paint thereby allowing the points to be illuminated in a darken room. A minute hand 32 is affixed to the free end of the innermost shaft 17 which extends furthest out. The hour hand 34 is affixed onto the free end of the intermediate shaft, wherein shaft is shorter than shaft 17. The second hand is affixed to the front face 28 of the dial 26 which is affixed to the free end of the outermost shaft which is the shortest shaft. Therefore, the hands are arranged with respect to the dial such that the second hand is on the dial, the minute hand is farthest from the dial, with the hour hand between the second and minute hands. The second hand is affixed permanently to the front face of the dial by an adhesive means, screw members (not shown), welding, or any other means which will form an integral bond between the second hand and the dial. As the second hand rotates through 360° during a one minute interval, the dial will rotate in conjunction with the second hand through 360° in a one minute interval. Therefore, the observer sees the points on the dial moving radially around. The given hour can be easily seen when the second hand and indicia of twelve are aligned vertically upward. Alternately, five minute interval markings can be radially contained around the outer annular flange member on the open front wall 14.

Since obvious changes may be made in the specific embodiment of the invention described herein, such modifications being within the spirit and scope of the invention claimed, it is indicated that all matter contained herein is intended as an illustrative and not as limiting in scope.

Having thus described the invention, what I claim as new and desired to secure by Letters Patent is:

1. A time clock, which comprises:

a. a clock housing having an open front wall and an interior chamber therein;

b. a clock mechanism contained in said chamber of said housing;

c. a ternary of shafts arranged one within another for rotation, said ternary of shafts communicating with said clock mechanism;

d. a dial having a front face with points equidistantly spaced radially there around and a center aperture therethrough, said ternary of shafts extending through said center aperture of said dial;

e. a minute hand affixed to an outer free end of said longest shaft;

f. a second hand affixed to an outer free end of said shortest shaft;

g. an hour hand affixed to an outer free end of said intermediate shaft;

h. means for integrally joining said second hand to said front face of said dial, said dial rotating in union with said second hand; and i. a transparent lens contained across said open front wall covering said dial.

2. A time clock according to claim 1, wherein said means for joining is a weld bond.

3. A time clock according to claim 1, wherein said means is a screw means.

4. A time clock according to claim 1, wherein said means is an adhesive.

5. A time clock according to claim 1, wherein an annular flange affixes said lens to said housing.

6. A time clock according to claim 5, wherein indicia are equidistantly spaced radially around said flange.

* * * * *